US007506502B2

(12) United States Patent
Nakano et al.

(10) Patent No.: US 7,506,502 B2
(45) Date of Patent: Mar. 24, 2009

(54) EXHAUST GAS PURIFYING SYSTEM FOR INTERNAL COMBUSTION ENGINE

(75) Inventors: Yasuaki Nakano, Sunto-gun (JP); Shinya Hirota, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 732 days.

(21) Appl. No.: 10/938,561

(22) Filed: Sep. 13, 2004

(65) Prior Publication Data

US 2005/0060987 A1 Mar. 24, 2005

(30) Foreign Application Priority Data

Sep. 24, 2003 (JP) ..... 2003-331615

(51) Int. Cl.
*F01N 3/00* (2006.01)

(52) U.S. Cl. ..... 60/285; 60/286; 60/295; 60/297; 60/301; 60/303

(58) Field of Classification Search ..... 60/274, 60/276, 285, 286, 295, 297, 301, 303
See application file for complete search history.

(56) References Cited

U.S. PATENT DOCUMENTS

| | | | | |
|---|---|---|---|---|
| 5,471,836 | A * | 12/1995 | Takeshima et al. | 60/297 |
| 6,182,443 | B1 * | 2/2001 | Jarvis et al. | 60/274 |
| 6,182,444 | B1 * | 2/2001 | Fulton et al. | 60/277 |
| 6,192,675 | B1 * | 2/2001 | Hirota et al. | 60/286 |
| 6,988,361 | B2 * | 1/2006 | van Nieuwstadt et al. | 60/295 |
| 6,996,975 | B2 * | 2/2006 | Radhamohan et al. | 60/286 |
| 7,178,331 | B2 * | 2/2007 | Blakeman et al. | 60/301 |

FOREIGN PATENT DOCUMENTS

| | | | |
|---|---|---|---|
| DE | 199 18 756 | A1 | 10/2000 |
| JP | A-6-200741 | | 7/1994 |
| JP | 11-153021 | A | 6/1999 |
| JP | A-2000-087732 | | 3/2000 |
| JP | A-2000-274232 | | 10/2000 |
| JP | 2001-059417 | A | 3/2001 |
| JP | A-2001-207832 | | 8/2001 |
| WO | WO 00/64566 | A1 | 11/2000 |

* cited by examiner

*Primary Examiner*—Binh Q. Tran
(74) *Attorney, Agent, or Firm*—Oliff & Berridge, PLC

(57) ABSTRACT

In an exhaust gas purifying system including two NOx catalysts disposed in series with each other on an exhaust passage, oxides occluded in the NOx catalysts can be reduced appropriately. When the oxides occluded in an upstream or downstream NOx catalyst are reduced, the surrounding atmosphere of each NOx catalyst is changed between a reducing atmosphere and an oxidative atmosphere. The air-fuel ratio of exhaust gas upstream of the upstream NOx catalyst is made lower when the surrounding atmosphere of the downstream NOx catalyst is changed into a reducing atmosphere than when the surrounding atmosphere of the upstream NOx catalyst is changed into a reducing atmosphere, and the duration of the oxidative atmosphere is made longer when the surrounding atmosphere of the downstream NOx catalyst is changed into an oxidative atmosphere than when the surrounding atmosphere of the upstream NOx catalyst is changed into an oxidative atmosphere.

8 Claims, 8 Drawing Sheets

EXHAUST GAS PURIFYING SYSTEM FOR INTERNAL COMBUSTION ENGINE

FIELD OF THE INVENTION

The present invention relates to an exhaust gas purifying system for an internal combustion engine including two NOx catalysts disposed in series with each other on an exhaust passage.

DESCRIPTION OF THE RELATED ART

In an exhaust gas purifying system for an internal combustion engine having NOx storage reduction catalysts (hereinafter referred to as NOx catalysts) installed on an exhaust passage, it is necessary to recover the exhaust gas cleaning or purification abilities of the NOx catalysts by reducing NOx and SOx (hereinafter referred to as oxides) occluded in the NOx catalysts. Accordingly, in such an internal combustion engine, NOx reduction control and/or SOx reduction control to reduce the oxides occluded in the NOx catalysts are/is carried out by alternately changing the surrounding atmospheres of the NOx catalysts between oxidative atmospheres and reducing atmospheres.

As such NOx reduction control, there has been known a technique in which in an exhaust gas purifying system for an internal combustion engine including two NOx catalysts disposed in series with each other on an exhaust passage, a reducing agent intermittently supplied to an exhaust gas at a location upstream of an upstream NOx catalyst is increased when the NOx occluded in a downstream NOx catalyst is reduced, and secondary air is supplied to the exhaust gas from a secondary air supply system arranged between the upstream NOx catalyst and the downstream NOx catalyst (for example, see Japanese patent application laid-open No. 6-200741). Also, in case of SOx reduction control, there has been known a technique in which, similar to such NOx reduction control, an amount of reducing agent to be supplied to an exhaust gas is increased, with secondary air being supplied to the exhaust gas (for example, see Japanese patent application laid-open No. 2000-87732).

In addition, Japanese patent application laid-open Nos. 2000-274232 and 2001-207832 are referred to as other patent documents which are relevant to the disclosure of the present invention.

In order to effectively perform the cleaning or purification of exhaust gas in an exhaust gas purifying system for an internal combustion engine including two NOx catalysts disposed in series with each other on an exhaust passage, it is necessary to reduce occluded oxides from both an upstream NOx catalyst and a downstream NOx catalyst.

SUMMARY OF THE INVENTION

Accordingly, the object of the present invention is to provide a technique in which in an exhaust gas purifying system for an internal combustion engine including two NOx catalysts disposed in series with each other on an exhaust passage, the oxides occluded in the NOx catalysts can be reduced in an appropriate manner.

According to the present invention, in order to achieve the above-mentioned object, the following solution is adopted.

That is, in an exhaust gas purifying system for an internal combustion engine including two NOx catalysts disposed in series with each other on an exhaust passage, when the oxides occluded in the upstream NOx catalyst or the downstream NOx catalyst is reduced, the surrounding atmosphere of each of the NOx catalysts is changed between a reducing atmosphere and an oxidative atmosphere. When the surrounding atmosphere of the downstream NOx catalyst is changed into a reducing atmosphere, the air-fuel ratio of exhaust gas at the upstream side of the upstream NOx catalyst is made lower than that when the surrounding atmosphere of the upstream NOx catalyst is changed into a reducing atmosphere, and when the surrounding atmosphere of the downstream NOx catalyst is changed into an oxidative atmosphere, the duration of the oxidative atmosphere is made longer than that when the surrounding atmosphere of the upstream NOx catalyst is changed into an oxidative atmosphere.

More specifically, an exhaust gas purifying system for an internal combustion engine according to one aspect of the present invention is characterized by comprising: a first NOx storage reduction catalyst disposed on an exhaust passage; a second NOx storage reduction catalyst disposed on the exhaust passage at a location downstream of the first NOx storage reduction catalyst; and an air-fuel ratio changing device that serves to control the air-fuel ratio of exhaust gas in the following manner. That is, when oxides occluded in the first NOx storage reduction catalyst or the second NOx storage reduction catalyst are reduced, the surrounding atmosphere of that one of the first and second NOx storage reduction catalysts, in which the oxides are reduced, is changed between an oxidative atmosphere and a reducing atmosphere by intermittently supplying a reducing agent to an exhaust gas at a location upstream of the first NOx storage reduction catalyst thereby to change the air-fuel ratio of the exhaust gas at an upstream side of the first NOx storage reduction catalyst. When the surrounding atmosphere of the second NOx storage reduction catalyst is changed into a reducing atmosphere, the air-fuel ratio of the exhaust gas at an upstream side of the first NOx storage reduction catalyst is made lower than when the surrounding atmosphere of the first NOx storage reduction catalyst is changed into a reducing atmosphere. When the surrounding atmosphere of the second NOx storage reduction catalyst is changed into an oxidative atmosphere, the duration of the oxidative atmosphere is made longer than when the surrounding atmosphere of the first NOx storage reduction catalyst is changed into an oxidative atmosphere.

Here, note that the exhaust gas air-fuel ratio is an air-fuel ratio of the exhaust gas, which, in the case of the reducing agent being other than fuel, is a value obtained by equivalently converting the mass of the reducing agent into the mass of the fuel.

In the present invention, when the reducing agent is supplied to the upstream side of the first NOx catalyst, the air-fuel ratio of exhaust gas at the upstream side of the first NOx catalyst (hereinafter referred to as an upstream side exhaust gas air-fuel ratio) lowers, and exhaust gas of a low air-fuel ratio containing reducing components flows into the first NOx catalyst. As a result, the surrounding atmosphere of the first NOx catalyst becomes a reducing atmosphere. On the other hand, when the supply of the reducing agent at the upstream side of the first NOx catalyst is stopped, the upstream side exhaust gas air-fuel ratio rises so that exhaust gas of a high air-fuel ratio flows into the first NOx catalyst. As a result, the surrounding atmosphere of the first NOx catalyst becomes an oxidative atmosphere. Therefore, the oxides occluded in the first NOx catalyst can be reduced by intermittently supplying the reducing agent to the upstream side of the first NOx catalyst thereby to change the upstream side exhaust gas air-fuel ratio.

In addition, by intermittently supplying the reducing agent to the upstream side of the first NOx catalyst thereby to change the upstream side exhaust gas air-fuel ratio, the exhaust gas air-fuel ratio at the downstream side of the first NOx catalyst, i.e., the air-fuel ratio of the exhaust gas flowing into the second NOx catalyst, can also be changed, similar to the exhaust gas flowing into the first NOx catalyst. Accordingly, the surrounding atmosphere of the second NOx catalyst can be changed into a reducing atmosphere or an oxidative atmosphere.

However, since the reducing agent is supplied to the upstream side of the first NOx catalyst, at least part of the reducing components is used to reduce oxides in the first NOx catalyst, so that the amount of the reducing components will decrease in the exhaust gas flowing into the second NOx catalyst. Therefore, in case where the surrounding atmosphere of the second NOx catalyst is to be changed into a reducing atmosphere, if the upstream side exhaust gas air-fuel ratio is made to be the same air-fuel ratio at the time when the surrounding atmosphere of the first NOx catalyst is changed into a reducing atmosphere, the reducing components might become short.

Moreover, for the reduction of oxides by reducing components in the first NOx catalyst, the oxygen in the exhaust gas is used to oxidize the reducing components and the like, so the amount of oxygen in the exhaust gas flowing into the second NOx catalyst decreases, too. Therefore, there is fear that even if the reducing agent reaches the second NOx catalyst, oxygen will become short, so the reducing components might be discharged as they are, generating white smoke, or in the case of the occluded oxides being SOx, $H_2S$ might be generated.

Accordingly, in the present invention, when the surrounding atmosphere of the second NOx catalyst is changed into a reducing atmosphere upon reduction of the oxides occluded in the second NOx catalyst, the upstream side exhaust gas air-fuel ratio is made lower than when the surrounding atmosphere of the first NOx catalyst is changed into a reducing atmosphere upon reduction of the oxides occluded in the first NOx catalyst. Thus, the amount of reducing components in the exhaust gas is increased by lowering the upstream side exhaust gas air-fuel ratio, so the amount of reducing components, which passes through the first NOx catalyst to reach the second NOx catalyst, can also be increased.

Further, when the surrounding atmosphere of the second NOx catalyst is changed into an oxidative atmosphere upon reduction of the oxides occluded in the second NOx catalyst, the duration of the oxidative atmosphere is made longer than when the surrounding atmosphere of the first NOx catalyst is changed into an oxidative atmosphere upon reduction of the oxides occluded in the first NOx catalyst. By increasing the duration of the oxidative atmosphere, the amount of the oxygen that passes through the first NOx catalyst to reach the second NOx catalyst can be increased. At this time, by increasing a duration for which the supply of the reducing agent at the upstream side of the first NOx catalyst is stopped, the duration of the oxidative atmosphere is increased.

According to the present invention, the amounts of reducing components and oxygen required to reduce the oxides occluded in the second NOx catalyst can be supplied to the second NOx catalyst. In addition, a sufficient amount of oxygen can be supplied to the second NOx catalyst without the provision of a secondary air supply system as used conventionally. Thus, it is possible to suppress the generation of white smoke or $H_2S$. Accordingly, the oxides occluded in the first and second NOx catalysts can be reduced in a more appropriate manner.

In the present invention, the reducing agent may be fuel. In this case, the air-fuel ratio changing device supplies fuel to the upstream side of the first NOx catalyst by injecting the fuel into a combustion chamber or an exhaust passage a plurality of times, through the injection of auxiliary fuel in the internal combustion engine, or the addition of fuel in the exhaust passage at the upstream side of the first NOx catalyst, etc. Further, in the present invention, when the surrounding atmosphere of the second NOx catalyst is changed into a reducing atmosphere, the air-fuel ratio of the exhaust gas at the upstream of the first NOx catalyst can be made lower by injecting the same amount of fuel with a decreased frequency or number of injections but in an increased amount of fuel per injection in comparison with the time when the surrounding atmosphere of the first NOx catalyst is changed into a reducing atmosphere.

This is because in case where the air-fuel ratio of exhaust gas is lowered by injecting fuel to the combustion chamber or the exhaust passage a plurality of times, even if the total amount of fuel to be supplied is the same, the air-fuel ratio of exhaust gas can be made lower when the frequency or number of injections is small but the amount of fuel per injection is large than when the frequency or number of injections is large but the amount of fuel per injection is small.

According to the present invention, when the surrounding atmosphere of the second NOx catalyst is changed into a reducing atmosphere, the upstream side exhaust gas air-fuel ratio can be efficiently lowered with a smaller amount of fuel supply by controlling the injection of fuel into the combustion chamber or exhaust passage in the above-mentioned manner. As a result, deterioration in fuel mileage can be suppressed.

In the present invention, the second NOx catalyst may have a characteristic that it is activated at a temperature lower than that at which the first NOx catalyst is activated.

In the NOx catalysts, those which are activated at lower temperature can reduce the oxides occluded therein earlier with a smaller amount of the reducing agent.

Accordingly, with the above-mentioned arrangement, the amount of reducing components which pass through the second NOx catalyst so as to be discharged as they are, can be made smaller, so the generation of white smoke can be further suppressed. Additionally, in the case of the reducing agent being fuel, deterioration in fuel economy can also be suppressed more effectively.

In the present invention, the reducing agent is not limited to fuel, but it may be, for example, kerosene or the like stored in a tank arranged separately from a fuel tank.

Furthermore, the present invention can adopt the following solution.

That is, an exhaust gas purifying system for an internal combustion engine according to another aspect of the present invention is characterized by comprising: a first NOx storage reduction catalyst disposed on an exhaust passage: a second NOx storage reduction catalyst disposed on the exhaust passage at a location downstream of the first NOx storage reduction catalyst and having an activation temperature different from that of the first NOx storage reduction catalyst: and an air-fuel ratio changing device that serves to control the air-fuel ratio of exhaust gas in the following manner. That is, when the NOx occluded in the first NOx storage reduction catalyst and/or the second NOx storage reduction catalyst are/is reduced, the surrounding atmosphere of that one of the first and second NOx storage reduction catalysts, in which the NOx is reduced, is changed between an oxidative atmosphere and a reducing atmosphere by intermittently supplying a reducing agent to the exhaust gas at a location upstream of the first NOx storage reduction catalyst thereby to change the air-fuel ratio of the exhaust gas at an upstream side of the first NOx storage reduction catalyst. When the NOx occluded in the first NOx storage reduction catalyst and/or the second NOx storage reduction catalyst are/is reduced, the NOx occluded in the first NOx storage reduction catalyst is reduced, or the NOx occluded in the second NOx storage reduction catalyst is reduced, or the NOx occluded in the first and second NOx storage reduction catalysts are reduced in accordance with the temperatures of the first NOx storage reduction catalyst and the second NOx storage reduction catalyst. When the surrounding atmospheres of the first and second NOx storage reduction catalysts are changed into reducing atmospheres, the air-fuel ratio of exhaust gas at an upstream side of the first NOx storage reduction catalyst is made lower than when the surrounding atmosphere of the first NOx storage reduction catalyst is changed into a reducing atmosphere. When the surrounding atmospheres of the first and second NOx storage reduction catalysts are changed into oxidative atmospheres, the duration of the oxidative atmosphere is made longer than when the surrounding atmosphere of the first NOx storage reduction catalyst is changed into an oxidative atmosphere. When the surrounding atmosphere of the second NOx storage reduction catalyst is changed into a reducing atmosphere, the air-fuel ratio of exhaust gas at an upstream side of the first NOx storage reduction catalyst is made lower than when the surrounding atmospheres of the first and second NOx storage reduction catalysts are changed into reducing atmospheres. When the surrounding atmosphere of the second NOx storage reduction catalyst is changed into an oxidative atmosphere, the duration of the oxidative atmosphere is made longer than when the surrounding atmospheres of the first and second NOx storage reduction catalysts are changed into oxidative atmospheres.

In the present invention, the first NOx catalyst and the second NOx catalyst are different from each other in their activation temperatures. Accordingly, when the NOx occluded in the first NOx catalyst and/or the second NOx catalyst are/is reduced, a determination as to which of the NOx catalysts is activated is made according to the temperatures of the respective NOx catalysts, and the occluded NOx is reduced from the NOx catalyst that is in an activated state. At this time, when both the first NOx catalyst and the second NOx catalyst are activated, the occluded NOx is reduced from both of the NOx catalysts.

Further, in the present invention, similar to the above, when the NOx occluded in the first NOx catalyst is reduced, the surrounding atmosphere of the first NOx catalyst is alternately changed between an oxidative atmosphere and a reducing atmosphere, whereas when the NOx occluded in the second NOx catalyst is reduced, the surrounding atmosphere of the second NOx catalyst is alternately changed between an oxidative atmosphere and a reducing atmosphere. In addition, when the NOx occluded in the first NOx catalyst and the second NOx catalyst are reduced, the surrounding atmospheres of both the first NOx catalyst and the second NOx catalyst are alternately changed between an oxidative atmosphere and a reducing atmosphere.

At this time, similar to the above, by lowering the upstream side exhaust gas air-fuel ratio, not only the surrounding atmosphere of the first NOx catalyst but also the atmosphere of the second NOx catalyst is changed into a reducing atmosphere. Also, similar to the above, by increasing the duration of the oxidative atmosphere, not only the surrounding atmosphere of the first NOx catalyst but also the atmosphere of the second NOx catalyst is changed into a reducing atmosphere.

Furthermore, when the NOx occluded in the first NOx catalyst and the second NOx catalyst are reduced, it is necessary to supply reducing components and oxygen to not only the first NOx catalyst but also the second NOx catalyst. However, at this time, both the first NOx catalyst and the second NOx catalyst are activated, so the amount of NOx occluded in the second NOx catalyst is smaller than when the NOx occluded in the second NOx catalyst is reduced, i.e., when the first NOx catalyst is not activated and only the second NOx catalyst is activated. Therefore, the amount of reducing components and oxygen required to reduce the NOx decreases, too.

Accordingly, in the present invention, when the surrounding atmospheres of the first and second NOx catalysts are changed into reducing atmospheres, the upstream side exhaust gas air-fuel ratio is made lower than when the surrounding atmosphere of the first NOx catalyst is changed into a reducing atmosphere, whereas when the surrounding atmosphere of the second NOx catalyst is changed into a reducing atmosphere, the upstream side exhaust gas air-fuel ratio is made lower than when the surrounding atmospheres of the first and second NOx catalysts are changed into reducing atmospheres.

Still further, when the surrounding atmospheres of the first and second NOx catalysts are changed into oxidative atmospheres, the duration of the oxidative atmospheres is made longer than when the surrounding atmosphere of the first NOx catalyst is changed into an oxidative atmosphere, whereas the surrounding atmosphere of the second NOx catalyst is changed into an oxidative atmosphere, the duration of the oxidative atmosphere is made longer than when the surrounding atmospheres of the first and second NOx catalysts are changed into oxidative atmospheres.

According to the present invention, the amounts of reducing components and oxygen required to reduce the oxides occluded in the first and second NOx catalysts can be supplied to the first and second NOx catalysts, respectively. In addition, a sufficient amount of oxygen can be supplied to the second NOx catalyst without the provision of a secondary air supply system as used conventionally. Thus, it is possible to suppress the generation of white smoke.

Further, in each of the NOx catalysts, the reduction of NOx is performed at the time when the NOx catalyst has been activated, so the NOx can be reduced earlier with a smaller amount of the reducing agent. Accordingly, the generation of white smoke can be suppressed, and in case where the reducing agent is fuel, deterioration in fuel economy can also be suppressed.

Thus, according to the present invention, the NOx occluded in the first and second NOx catalysts can be reduced in a more appropriate manner.

Preferably, in the present invention, the reducing agent is fuel, and the air-fuel ratio changing device serves to control the air-fuel ratio of the exhaust gas in the following manner. That is, when fuel is supplied to the exhaust gas at a location upstream of the first NOx storage reduction catalyst, the fuel is injected a plurality of times. When the surrounding atmospheres of the first and second NOx storage reduction catalysts are changed into reducing atmospheres, the air-fuel ratio of the exhaust gas at an upstream side of the first NOx storage reduction catalyst is further lowered by supplying the same amount of fuel to the exhaust gas at a location upstream of the first NOx storage reduction catalyst at a decreased frequency of injections with an increased amount of fuel per injection, in comparison with the time when the surrounding atmosphere of the first NOx storage reduction catalyst is changed into a reducing atmosphere. When the surrounding atmosphere of the second NOx storage reduction catalyst is changed into a reducing atmosphere, the air-fuel ratio of the exhaust gas at an upstream side of the first NOx storage reduction catalyst is further lowered by supplying the same amount of fuel to the exhaust gas at a location upstream of the first NOx storage reduction catalyst at a decreased frequency of injections with an increased amount of fuel per injection, in comparison with the time when the surrounding atmospheres of the first and second NOx storage reduction catalysts are changed into reducing atmospheres.

This is because even if the total amount of fuel to be supplied is the same, the air-fuel ratio of exhaust gas can be made lower when the frequency or number of injections is small but the amount of fuel per injection is large than when the frequency or number of injections is large but the amount of fuel per injection is small. Therefore, the upstream side exhaust gas air-fuel ratio can be efficiently lowered with a smaller amount of fuel supply, thus making it possible to suppress deterioration in fuel economy.

Preferably, in the present invention, the air-fuel ratio changing device serves to control the air-fuel ratio of the exhaust gas in the following manner. That is, when the temperature of only the first NOx storage reduction catalyst is within a first activation temperature range, the NOx occluded in the first NOx storage reduction catalyst is reduced. When the temperature of only the second NOx storage reduction catalyst is within a second activation temperature range, the NOx occluded in the second NOx storage reduction catalyst is reduced. When the temperatures of both the first and second NOx storage reduction catalysts are within the first and second activation temperature ranges, respectively, the NOx occluded in the first and second NOx storage reduction catalysts are reduced. Here, note that the first activation temperature range is an activation temperature range of the first NOx storage reduction catalyst, and the second activation temperature range is an activation temperature range of the second NOx storage reduction catalyst. In this manner, the occluded NOx can be reduced with good fuel economy.

Thus, according to an exhaust gas purifying system for an internal combustion engine of the present invention including two NOx catalysts disposed in series with each other on an exhaust passage, the oxides occluded in the NOx catalysts can be reduced in a more appropriate manner. As a result, the exhaust gas cleaning or purification abilities of the NOx catalysts can be recovered in a more appropriate manner, and hence the cleaning or purification of the exhaust gas can be performed more effectively.

The above and other objects, features and advantages of the present invention will become more readily apparent to those skilled in the art from the following detailed description of a preferred embodiment of the present invention taken in conjunction with the accompanying drawings.

BRIEF DESCRIPTION OF THE DRAWINGS

FIGS. 3A and 3B are timing charts showing how to control an upstream side exhaust gas air-fuel ratio at the time of SOx reduction control according to one embodiment of the present invention, wherein FIG. 3A illustrates how to control the upstream side exhaust gas air-fuel ratio when the SOx occluded in the upstream NOx catalyst is reduced, and FIG. 3B illustrates how to control the upstream side exhaust gas air-fuel ratio when the SOx occluded in the downstream NOx catalyst is reduced.

FIGS. 4A and 4B are timing charts showing how to control the fuel added from a fuel addition valve when the surrounding atmospheres of the NOx catalysts are changed into reducing atmospheres, respectively, according to one embodiment of the present invention, wherein FIG. 4A illustrates how to control the fuel added from the fuel addition valve when the surrounding atmosphere of the upstream NOx catalyst is changed into a reducing atmosphere, and FIG. 4B illustrates how to control the fuel added from the fuel addition valve when the surrounding atmosphere of the downstream NOx catalyst is changed into a reducing atmosphere.

FIGS. 6A through 6C are timing charts showing how to control the upstream side exhaust gas air-fuel ratio at the time of NOx reduction control according to one embodiment of the present invention, wherein FIG. 6A illustrates how to control the upstream side exhaust gas air-fuel ratio when the NOx occluded in the upstream NOx catalyst is reduced, and FIG. 6B illustrates how to control the upstream side exhaust gas air-fuel ratio when the NOx occluded in the upstream and downstream NOx catalysts are reduced and FIG. 6B illustrates how to control the upstream side exhaust gas air-fuel ratio when the NOx occluded in the downstream NOx catalyst is reduced.

DESCRIPTION OF THE PREFERRED EMBODIMENTS

Hereinafter, preferred embodiments of an exhaust gas purifying system for an internal combustion engine according to the present invention will be described in detail while referring to the accompanying drawings.

Embodiment 1

<Schematic Construction of the Internal Combustion Engine, Its Exhaust System and Control System>

Figure 1:
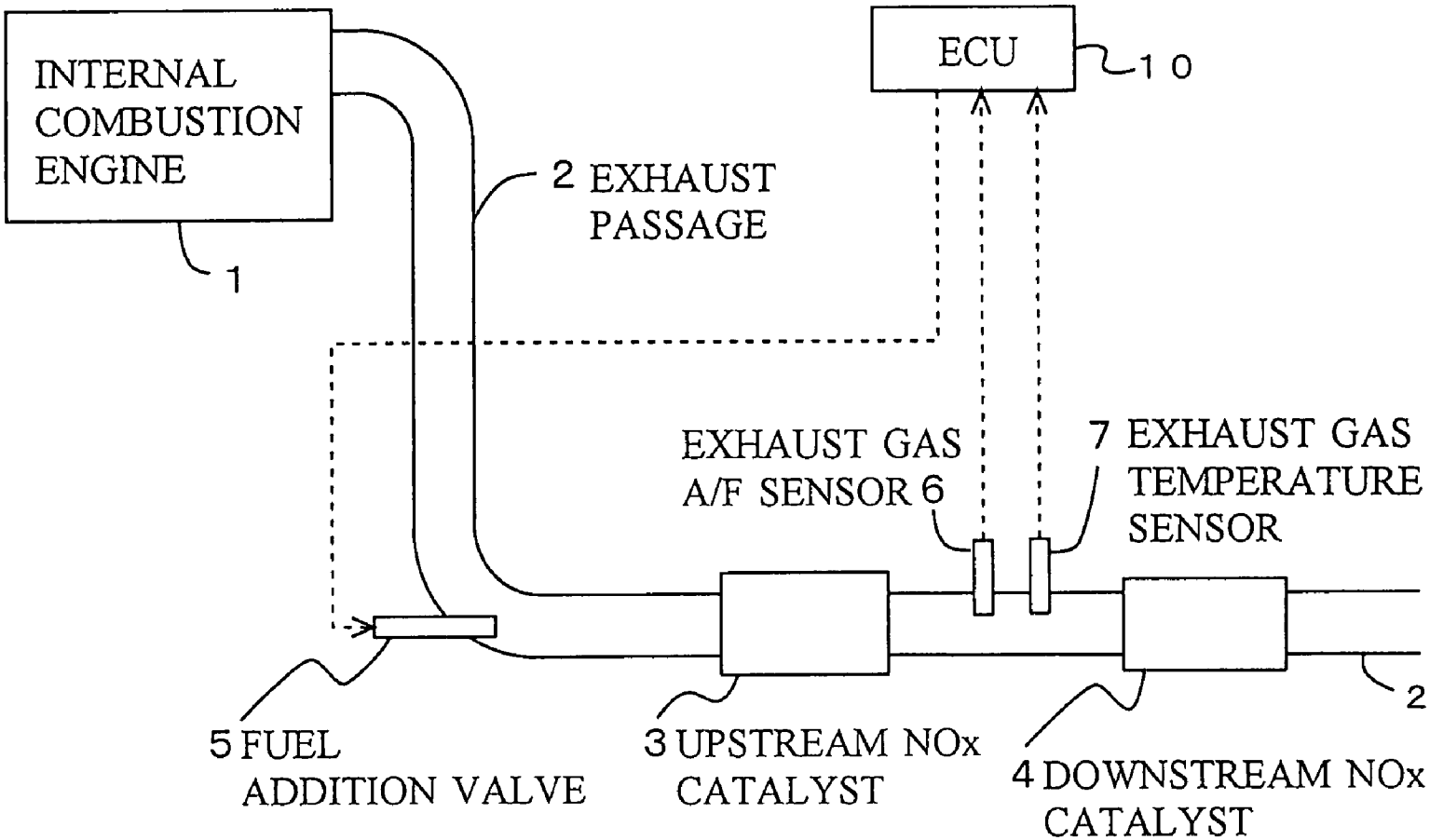
FIG. 1 is a view showing the schematic construction of an internal combustion engine with exhaust and control systems according to one embodiment of the present invention.

First, an exhaust gas purifying system for an internal combustion engine according to one embodiment of the present invention will be described. Here, reference will be made to the case where the present invention is applied to a diesel engine used for driving a vehicle. FIG. 1 illustrates the schematic construction of an internal combustion engine with exhaust and control systems according to the embodiment of the present invention.

The internal combustion engine 1 is a diesel engine for driving a vehicle. An exhaust passage 2 is connected with the internal combustion engine 1, and two NOx catalysts 3, 4 are disposed in series each other on the exhaust passage 2 (hereinafter, the NOx catalyst 3 arranged upstream of the other NOx catalyst 4 is referred to as an upstream NOx catalyst, and the NOx catalyst 4 arranged downstream of the NOx catalyst 3 is referred to as a downstream NOx catalyst.). Here, note that these NOx catalysts 3, 4 may comprise particulate filters carrying thereon NOx catalysts, respectively.

In the exhaust passage 2 at the downstream side of the upstream NOx catalyst 3 and at the upstream side of the downstream NOx catalyst 4, there are arranged an exhaust gas A/F sensor 6 for generating an electric signal corresponding to the air-fuel ratio of the exhaust gas passing through the exhaust passage 2 and an exhaust gas temperature sensor 7 for generating an electric signal corresponding to the temperature of the exhaust gas passing through the exhaust passage 2. A fuel addition valve 5 for adding a fuel as a reducing agent to the exhaust gas is arranged on the exhaust passage 2 at the upstream side of the upstream NOx catalyst 3.

An electronic control unit (ECU) 10 for controlling the internal combustion engine 1 is provided in conjunction with the engine 1 as constructed in the above manner. This ECU 10 serves to control the operating state of the internal combustion engine 1 in accordance with the operating condition of the internal combustion engine 1 and driver's requirements. A variety of kinds of sensors such as the exhaust gas A/F sensor 6, the exhaust gas temperature sensor 7, etc., are electrically connected with the ECU 10 so that the output signals of the various kinds of sensors are input to the ECU 10. The ECU 10 estimates the air-fuel ratio of the exhaust gas flowing into the upstream NOx catalyst 3 and the air-fuel ratio of the exhaust gas flowing into the downstream NOx catalyst 4 from the output value of the exhaust gas A/F sensor 6. Also, the ECU 10 estimates the temperature of the upstream NOx catalyst 3 and the temperature of the downstream NOx catalyst 4 from the output value of the exhaust gas temperature sensor 7. In addition, the ECU 10 is electrically connected with the fuel addition valve 5, and can control the fuel addition valve 5. Thus, the ECU 10 and the fuel addition valve 5 cooperate with each other to serve as an air-fuel ratio changing device for changing the air-fuel ratio of the exhaust gas.

Here, note that in this embodiment, an additional exhaust gas A/F sensor and an additional exhaust gas temperature sensor can be installed on a portion of the exhaust passage 2 downstream of the downstream NOx catalyst 4. With such an arrangement, NOx reduction control or SOx reduction control to be described later can be carried out more precisely.

<NOx Catalysts>

Figure 2:
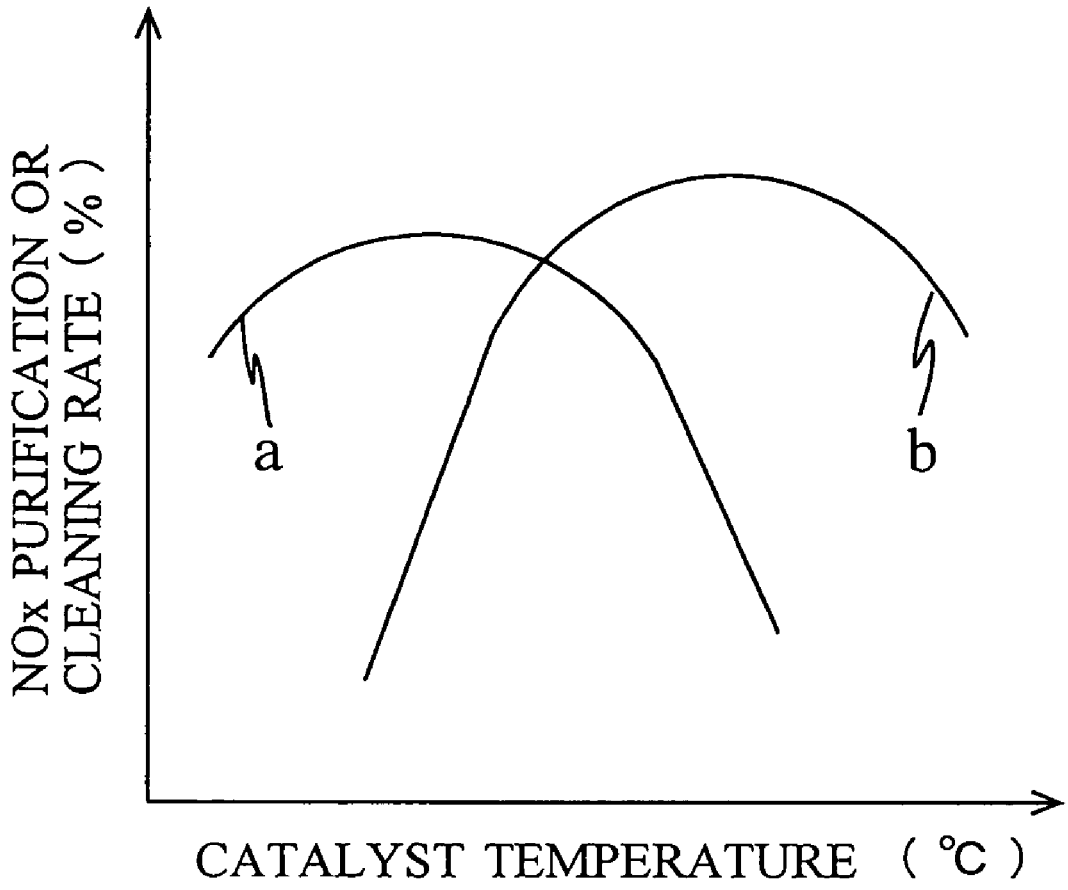
FIG. 2 is a graph illustrating the activation temperature characteristics of an upstream NOx catalyst and a downstream NOx catalyst according to one embodiment of the present invention.

Here, the NOx catalysts 3, 4 according to this embodiment will be described in detail based on FIG. 2. FIG. 2 is a graph that illustrates the activation temperature characteristics of the upstream NOx catalyst 3 and the downstream NOx catalyst 4. In the graph of FIG. 2, the axis of abscissa represents the temperature of the NOx catalyst, and the axis of ordinate represents the NOx purification or cleaning rate of the NOx catalyst. In addition, curve a represents the change in the NOx purification or cleaning rate of the downstream NOx catalyst 4 in accordance with the temperature, and curve b represents the change in the NOx purification or cleaning rate of the upstream NOx catalyst 3 in accordance with the temperature. As shown in FIG. 2, the downstream NOx catalyst 4 has a characteristic of being activated at a temperature lower than that at which the upstream NOx catalyst 3 is activated. For example, the upstream NOx catalyst 3 may have an activation temperature range of 300-500° C., and the downstream NOx catalyst 4 may have an activation temperature range of 150-350° C. In this manner, exhaust gas cleaning or purification can be made in a wider temperature range by the provision of the two NOx catalysts 3, 4 with different activation temperatures.

In addition, the NOx catalysts 3, 4 are NOx storage reduction catalysts capable of occluding and reducing the NOx in the exhaust gas. In order to reduce the NOx occluded in the NOx catalysts 3, 4, it is necessary to alternately change the surrounding atmosphere between an oxidative atmosphere of a high air-fuel ratio and a reducing atmosphere of a low air-fuel ratio containing a reducing agent. Hereinafter, such control of reducing the NOx is referred to as NOx reduction control.

Further, the NOx catalysts 3, 4 occlude the SOx in the exhaust gas similar the NOx. In order to reduce the SOx occluded in the NOx catalysts 3, 4, it is necessary to alternately change the surrounding atmosphere between an oxidative atmosphere of a high air-fuel ratio and a reducing atmosphere of a low air-fuel ratio containing a reducing agent, similarly to the above-mentioned NOx reduction control, as well as to raise the temperatures of the NOx catalysts 3, 4 higher than those at the time of NOx reduction control. Hereinafter, such control of reducing the SOx is referred to as SOx reduction control.

In this embodiment, when NOx reduction control or SOx reduction control is carried out, by intermittently adding fuel from the fuel addition valve 5 to the exhaust gas thereby to change the air-fuel ratio of exhaust gas at the upstream side of the upstream NOx catalyst 3, the surrounding atmospheres of the respective NOx catalysts are alternately changed between an oxidative atmosphere and a reducing atmosphere. That is, by decreasing the upstream side exhaust gas air-fuel ratio (i.e., the air-fuel ratio of the exhaust gas at the upstream side of the upstream NOx catalyst 3 in this embodiment), the surrounding atmospheres of the respective NOx catalysts 3, 4 can be changed into reducing atmospheres. On the other hand, by stopping the fuel addition from the fuel addition valve 5 thereby to raise the upstream side exhaust gas air-fuel ratio, the surrounding atmospheres of the respective NOx catalysts 3, 4 can be changed into oxidative atmospheres.

Here, note that in case where the activation temperatures of the respective NOx catalysts 3, 4 are not different from each other, or even in case where the upstream NOx catalyst 3 has a characteristic of being activated at a temperature lower than that at which the downstream NOx catalyst 4 is activated, the present invention can be applied.

<SOx Reduction Control>

Figure 3A:
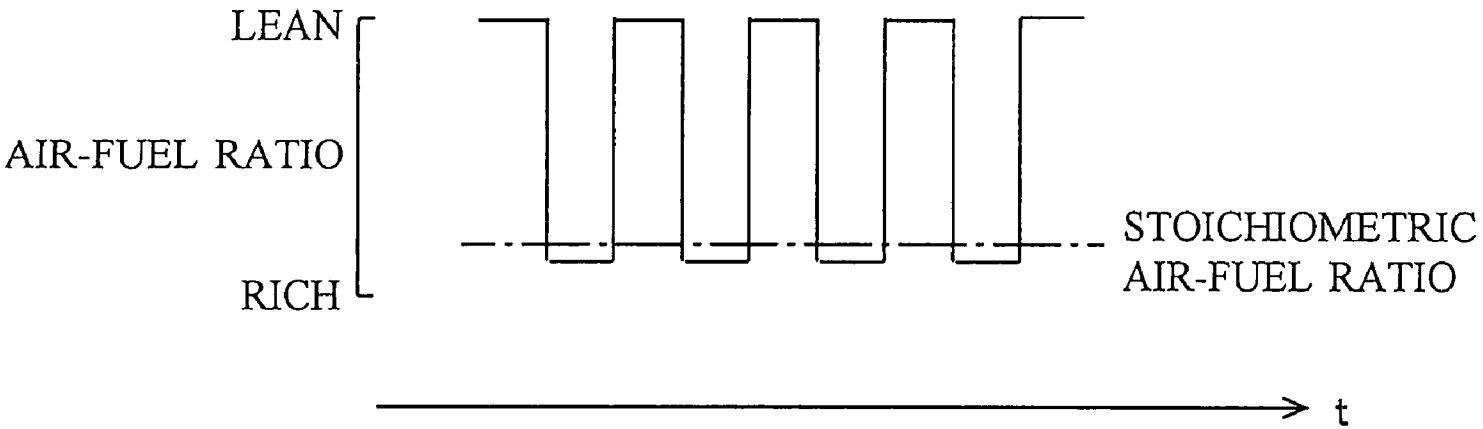
Figure 3B:
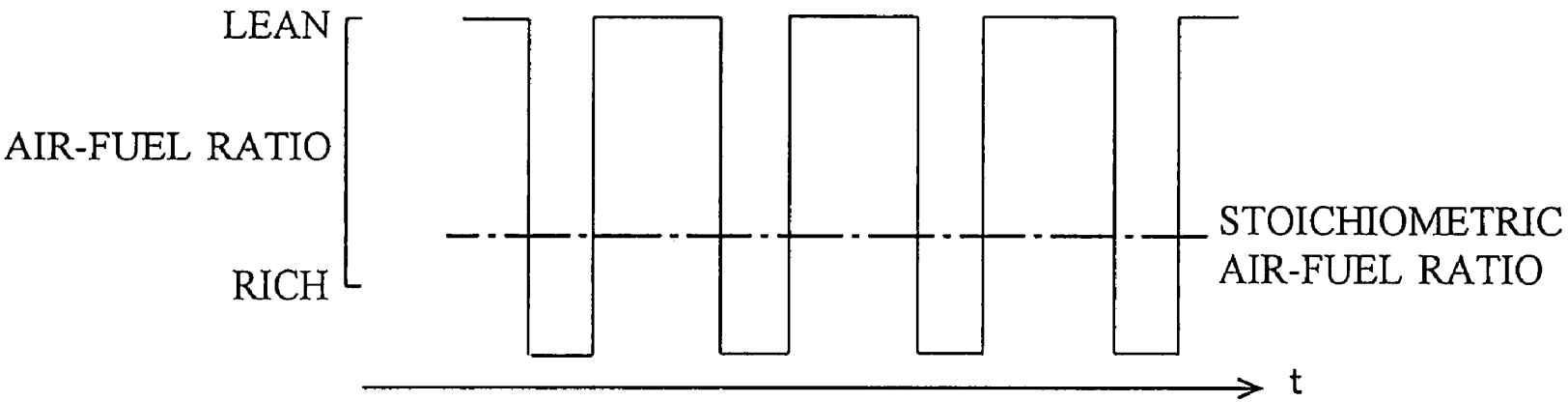

Next, reference will be made to the SOx reduction control in this embodiment based on FIGS. 3A and 3B. FIG. 3A is a timing chart that illustrates how to control the upstream side exhaust gas air-fuel ratio when the SOx occluded in the upstream NOx catalyst 3 is reduced. FIG. 3B is a timing chart that illustrates how to control the upstream side exhaust gas air-fuel ratio when the SOx occluded in the downstream NOx catalyst 4 is reduced. In FIGS. 3A and 3B, the axis of abscissa represents time, and the axis of ordinate represents the upstream side exhaust gas air-fuel ratio. Here, note that in this embodiment, when SOx reduction control is performed, by performing auxiliary fuel injection in the internal combustion engine 1, fuel addition from the fuel addition valve 5, etc., the temperatures of the respective NOx catalysts 3, 4 are controlled to be raised.

When the SOx occluded in the NOx catalysts 3 is reduced, the upstream side exhaust gas air-fuel ratio is alternately changed between a first rich air-fuel ratio in the vicinity of the stoichiometric air-fuel ratio and a lean air-fuel ratio, as shown in FIG. 3A. By controlling the upstream side exhaust gas air-fuel ratio in such a manner, the surrounding atmosphere of the upstream NOx catalyst 3 is alternately changed between an oxidative atmosphere and a reducing atmosphere, thereby reducing the SOx occluded in the upstream NOx catalyst 3.

On the other hand, when the NOx occluded in the downstream NOx catalyst 4 is reduced, the upstream side exhaust gas air-fuel ratio is alternately changed between a second rich air-fuel ratio smaller than the first rich air-fuel ratio in the vicinity of the stoichiometric air-fuel ratio and a lean air-fuel ratio, as shown in FIG. 3B. At this time, when the upstream side exhaust gas air-fuel ratio is changed into a rich air-fuel ratio, i.e., when the surrounding atmosphere of the downstream NOx catalyst 4 is changed into a reducing atmosphere, the upstream side exhaust gas air-fuel ratio is made lower than when the surrounding atmosphere of the upstream NOx catalyst 3 is changed into a reducing atmosphere upon reduction of the SOx occluded in the upstream NOx catalyst 3. In addition, at this time, when the upstream side exhaust gas air-fuel ratio is changed into a lean air-fuel ratio, i.e., when the surrounding atmosphere of the downstream NOx catalyst 4 is changed into an oxidative atmosphere, the period of time or duration for which the upstream side exhaust gas air-fuel ratio is at a lean air-fuel ratio is made longer than when the surrounding atmosphere of the upstream NOx catalyst 3 is changed into an oxidative atmosphere upon reduction of the SOx occluded in the upstream NOx catalyst 3. That is, the duration for which the surrounding atmosphere of the downstream NOx catalyst 4 is an oxidative atmosphere is made longer.

Even when the downstream NOx catalyst 4 is changed into a reducing atmosphere, the control of the surrounding atmosphere thereof is performed by controlling the upstream side exhaust gas air-fuel ratio, i.e., fuel addition from the fuel addition valve 5. Accordingly, at least part of the reducing components in the fuel added is used to reduce the SOx in the upstream NOx catalyst 3, so that the amount of the reducing components decreases in the exhaust gas flowing into the downstream NOx catalyst 4. Therefore, in this embodiment, when the surrounding atmosphere of the downstream NOx catalyst 4 is changed into a reducing atmosphere, the upstream side exhaust gas air-fuel ratio is made lower than when the surrounding atmosphere of the upstream NOx catalyst 3 is changed into a reducing atmosphere. Since the amount of reducing components in the exhaust gas is increased by controlling the fuel addition in this manner, the amount of reducing components that passes through the upstream NOx catalyst 3 to reach the downstream NOx catalyst 4 can also be increased.

Further, for the reduction of the oxides in the upstream NOx catalyst 3 by reducing components, the oxygen in the exhaust gas is used to oxidize the reducing components or the like, so the amount of oxygen in the exhaust gas flowing into the downstream NOx catalyst 4 decreases, too. Therefore, in this embodiment, when the surrounding atmosphere of the downstream NOx catalyst 4 is changed into an oxidative atmosphere, the duration of the oxidative atmosphere is made longer than when the surrounding atmosphere of the upstream NOx catalyst 3 is changed into an oxidative atmosphere. That is, the duration for which the fuel addition from the fuel addition valve 5 is stopped is made longer, so that the duration for which the upstream side exhaust gas air-fuel ratio is at a lean air-fuel ratio is increased. By performing such control, the amount of the oxygen that passes through the upstream NOx catalyst 3 to reach the downstream NOx catalyst 4 can be increased.

As described above, according to the SOx reduction control of the present invention, the amounts of reducing components and oxygen required to reduce the SOx occluded in the downstream NOx catalyst 4 can be supplied to the downstream NOx catalyst 4. In addition, a sufficient amount of oxygen can be supplied to the downstream NOx catalyst 4 without the provision of a secondary air supply system as used conventionally. Thus, it is possible to suppress the generation of white smoke or $H_2S$.

<Fuel Addition Control when Surrounding Atmospheres of NOx Catalysts are Changed Into Reducing Atmospheres During SOx Reduction Control>

Figure 4A:
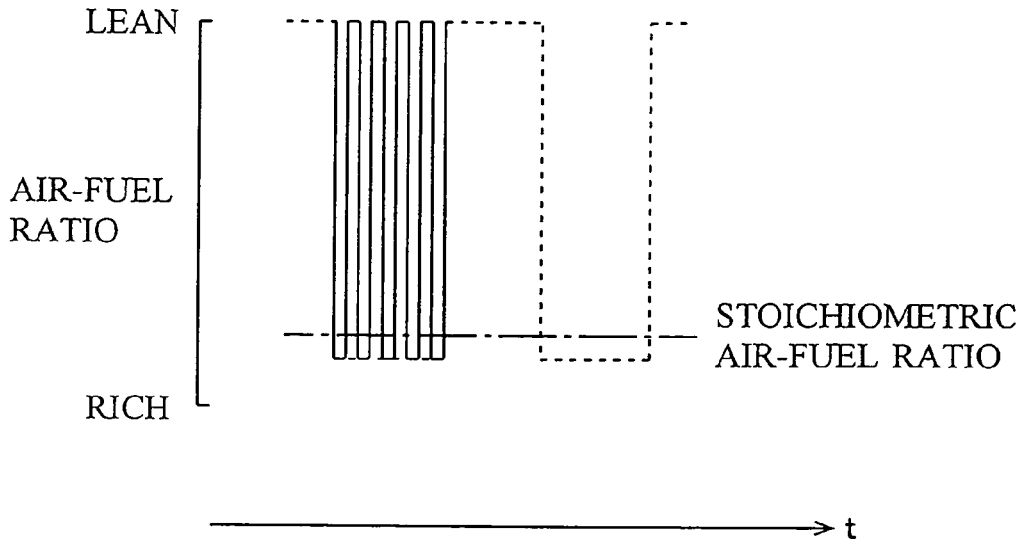
Figure 4B:
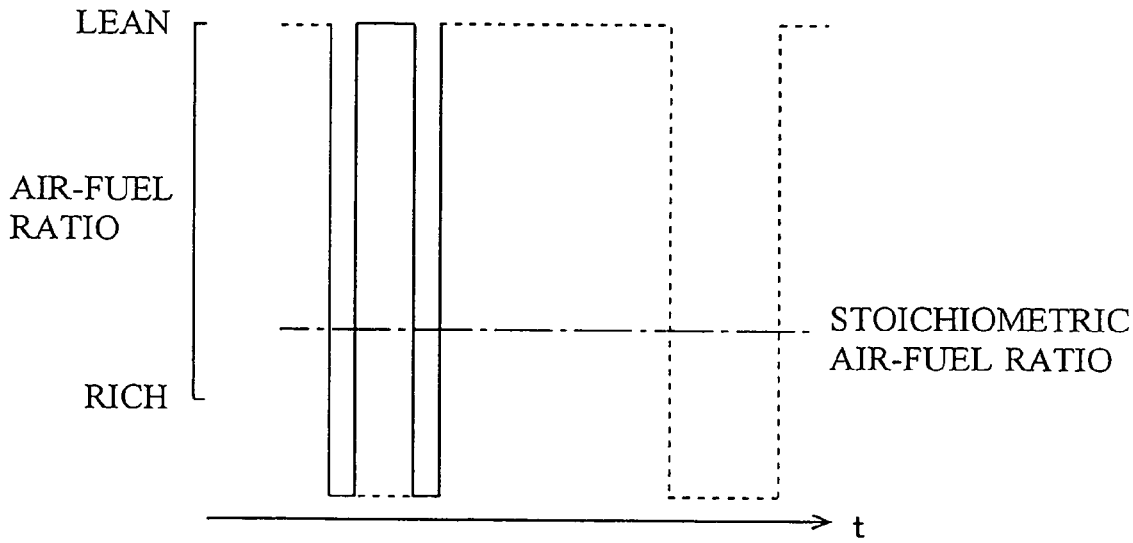

Next, reference will be made to the fuel addition control on the fuel added from the fuel addition valve 5 when the surrounding atmospheres of the respective NOx catalysts 3, 4 are changed into reducing atmospheres at the time of SOx reduction control in this embodiment, while referring to FIGS. 4A and 4B. FIG. 4A is a timing chart that illustrates the fuel addition control on the fuel added from the fuel addition valve 5 when the surrounding atmosphere of the upstream NOx catalyst 3 is changed into a reducing atmosphere. FIG. 4B is a timing chart that illustrates the fuel addition control on the fuel added from the fuel addition valve 5 when the surrounding atmosphere of the downstream NOx catalyst 4 is changed into a reducing atmosphere. In FIGS. 4A and 4B, the axis of abscissa represents time, and the axis of ordinate represents the upstream side exhaust gas air-fuel ratio, wherein broken lines indicate the upstream side exhaust gas air-fuel ratio in FIGS. 3A and 3B as mentioned above, and solid lines indicate the waveform of the fuel injection when fuel is added. That is, in FIGS. 4A and 4B, the fuel addition valve 5 injects fuel when solid line is on a rich air-fuel ratio side, and the fuel addition valve 5 does not inject fuel when solid line is on a lean air-fuel ratio side.

When the surrounding atmospheres of the respective NOx catalysts 3, 4 are changed into reducing atmospheres, i.e., when the upstream side exhaust gas air-fuel ratio is changed into a rich air-fuel ratio, the fuel addition valve 5 serves to add fuel to the exhaust gas by injecting the fuel a plurality of times, as shown in FIGS. 4A and 4B.

It has been experimentally found that in case where the air-fuel ratio of exhaust gas is lowered by injecting fuel into exhaust gas a plurality of times, even if the total amount of the fuel to be supplied is the same, the air-fuel ratio of the exhaust gas is made lower when the frequency or number of injections is small but the amount of fuel per injection is large than when the frequency or number of injections is large but the amount of fuel per injection is small.

Therefore, as shown in FIG. 4B, when the surrounding atmosphere of the downstream NOx catalyst 4 is changed into a reducing atmosphere, fuel is added to the exhaust gas by making the frequency of fuel injections smaller than and the amount of fuel per injection larger than when the surrounding atmosphere of the upstream NOx catalyst 3 is changed into a reducing atmosphere. Moreover, the total of the amounts of injected fuel in one fuel addition at this time (the broken line in FIG. 4B) may be equal to the total of the amounts of injected fuel in one fuel addition (the broken line in FIG. 4A) when the surrounding atmosphere of the upstream NOx catalyst 3 is changed into a reducing atmosphere.

According to the control on the fuel added from the fuel addition valve 5, when the surrounding atmosphere of the downstream NOx catalyst 4 is changed into a reducing atmosphere, the upstream side exhaust gas air-fuel ratio can be efficiently lowered with a smaller amount of fuel supply. As a result, deterioration in fuel mileage can be suppressed.

Here, note that in this embodiment, the upstream side exhaust gas air-fuel ratio when the surrounding atmospheres of the respective NOx catalysts 3, 4 are changed into reducing atmospheres is not limited to a rich air-fuel ratio. That is, the upstream side exhaust gas air-fuel ratio at this time may be the stoichiometric air-fuel ratio, or any appropriate lean air-fuel ratio at which the occluded SOx can be reduced in the respective NOx catalysts 3, 4.

<SOx Reduction Control Routine>

Figure 5:
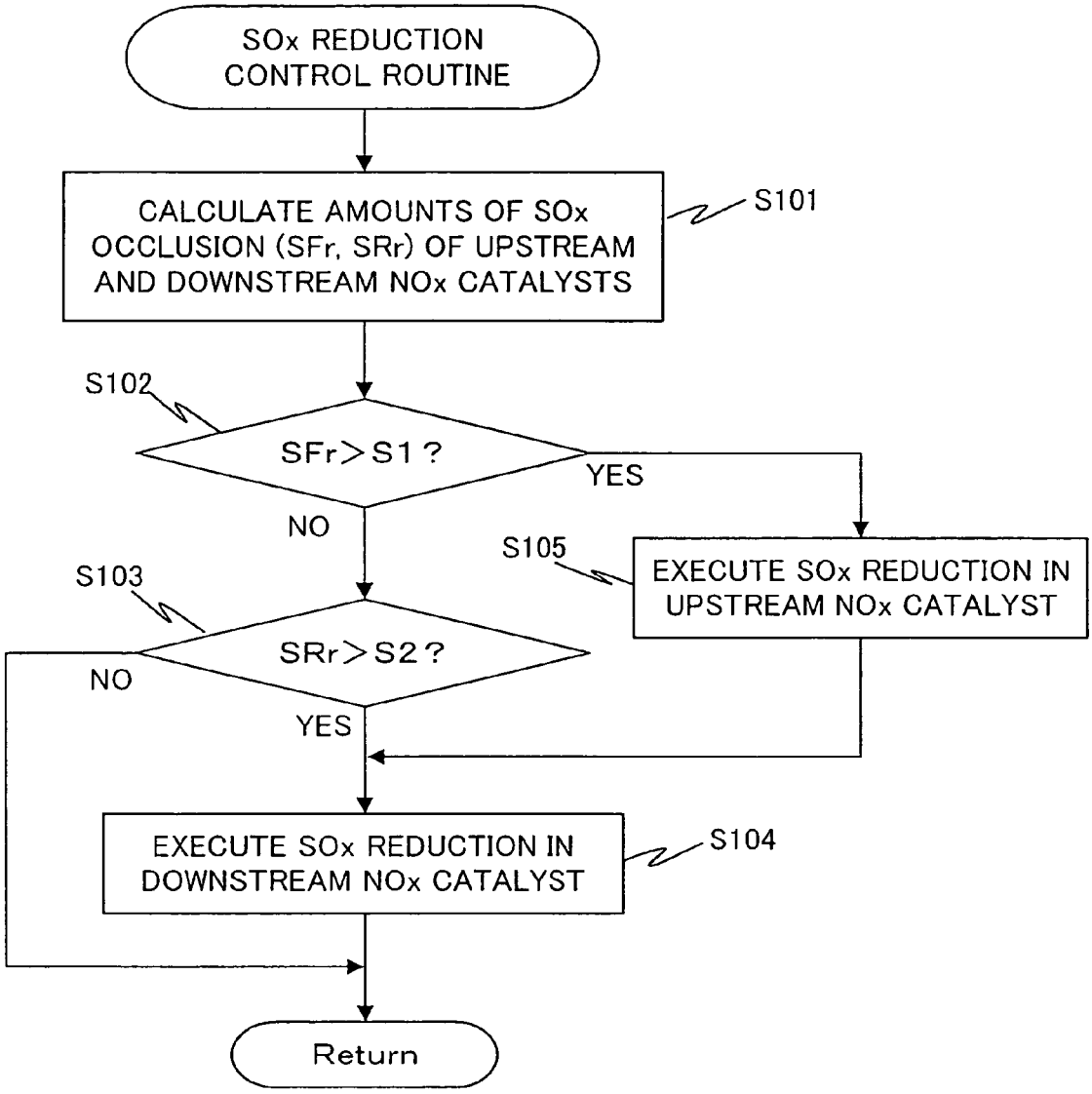
FIG. 5 is a flow chart showing a SOx reduction control routine according to one embodiment of the present invention.

Next, reference will be made to a control routine for SOx reduction control in this embodiment while referring to FIGS. 5. FIG. 5 is a flow chart that illustrates an SOx reduction control routine according to this embodiment. This routine is a program beforehand stored in the ECU 10, and is executed at each specified time interval during the operation of the internal combustion engine 1.

In this routine, first in S101, the ECU 10 calculates the amount of SOx occlusion SFr in the upstream NOx catalyst 3 and the amount of SOx occlusion SRr in the downstream NOx catalyst 4, respectively. At this time, the amount of SOx occlusion SFr in the upstream NOx catalyst 3 is calculated from the concentration of sulfur in the fuel and the integrated or accumulated value of the amount of fuel consumed in the internal combustion engine 1. On the other hand, the amount of SOx occlusion SRr in the downstream NOx catalyst 4 is calculated from the integrated or accumulated value of the amount of the SOx having passed through the upstream NOx catalyst 3 and the amount of the SOx reoccluded when the SOx occluded in the NOx catalysts 3 is reduced. Here, note that the amount of the SOx having passed through the upstream NOx catalyst 3 and the amount of the SOx reoccluded when the SOx occluded in the NOx catalysts 3 is reduced are derived from the output value of the A/F sensor 6.

Then, the control program or flow executed by the ECU 10 goes to step S102, where it is determined whether the amount of SOx occlusion SFr in the upstream NOx catalyst 3 is greater than a first specified amount of SOx occlusion S1. Here, note that the first specified amount of SOx occlusion S1 is a threshold which is a predetermined value for making a determination that when the amount of SOx occluded in the upstream NOx catalyst 3 is more than the first specified amount of SOx occlusion S1, the reduction of the occluded SOx is carried out. In step S102, when a positive determination is made, the control flow advances to step S105, whereas when a negative determination is made, the control flow advances to step S103.

In step S105, the upstream side exhaust gas air-fuel ratio is controlled in the above-mentioned manner so that the SOx occluded in the upstream NOx catalyst 3 is reduced. Thereafter, the control flow advances to step S104.

On the other hand, in step S103, it is determined whether the amount of SOx occlusion SRr in the downstream NOx catalyst 4 is more than a second specified amount of SOx occlusion S2. Here, note that the second specified amount of SOx occlusion S2 is a threshold which is a predetermined value for making a determination that when the amount of SOx occluded in the downstream NOx catalyst 4 is more than the second specified amount of SOx occlusion S2, the reduction of the occluded SOx is carried out. In this regard, the second specified amount of SOx occlusion S2 is set to a value that is smaller than said the first specified amount of SOx occlusion S1. This is because the downstream NOx catalyst 4 has the characteristic of being activated at a temperature lower than that at which the upstream NOx catalyst 3 is activated, and hence the downstream NOx catalyst 4, being able to be more easily activated at a low temperature, is liable to be decreased in its exhaust gas cleaning or purification performance even with a smaller amount of SOx occlusion more easily than the upstream NOx catalyst 3.

When a positive determination is made in step S103, the control flow advances to step S104. On the other hand, when a negative determination is made in step S103, a determination is made that an amount of SOx as necessary to be reduced is not occluded in each of the upstream NOx catalyst 3 and the downstream NOx catalyst 4, and the execution of this routine is once terminated.

In step S104, the upstream side exhaust gas air-fuel ratio is controlled in the above-mentioned manner so as to reduce the SOx occluded in the downstream NOx catalyst 4, and then the execution of this routine is once terminated.

According to the SOx reduction control routine as stated above, the SOx occluded in the respective NOx catalysts 3, 4 can be reduced at appropriate times, respectively. Therefore, the exhaust gas cleaning or purification ability can be recovered while suppressing deterioration in fuel mileage.

In addition, according to the SOx reduction control routine in this embodiment, after the SOx occluded in the upstream NOx catalyst 3 has been reduced, the SOx occluded in the downstream NOx catalyst 4 is reduced. This is because when the SOx occluded in the upstream NOx catalyst 3 has been reduced, the SOx thus reduced might be reoccluded in the downstream NOx catalyst 4. In addition, the exhaust gas cleaning or purification ability not only at high temperatures but also at low temperatures can be recovered by reducing the SOx from both the upstream NOx catalyst 3 and the downstream NOx catalyst 4 in this manner.

Moreover, the SOx reduction control need not be carried out until the amounts of SOx occlusion in the respective NOx catalysts 3, 4 become zero, but instead it is sufficient to perform the SOx reduction control just until the amounts of SOx occlusion are decreased to such an extent (hereinafter referred to as an SOx reduction stop amount) as to provide satisfactory exhaust gas cleaning or purification abilities in the NOx catalysts 3, 4, respectively. This is because the speed of release of SOx from the NOx catalysts 3, 4 decreases in accordance with the decreasing amount of SOx occlusion therein, so if the SOx reduction control is carried out until the amount of SOx occlusion in each NOx catalyst is decreased to zero, the operation time thereof becomes longer to increase the amount of fuel consumption, thus giving rise to deterioration in fuel economy. Here, note that since an NOx catalyst having a low temperature activation ability is liable to release the occluded SOx even with a smaller amount thereof, the SOx reduction stop amount may be made smaller in the downstream NOx catalyst 4 than in the upstream NOx catalyst 3.

<NOx Reduction Control>

Figure 6A:
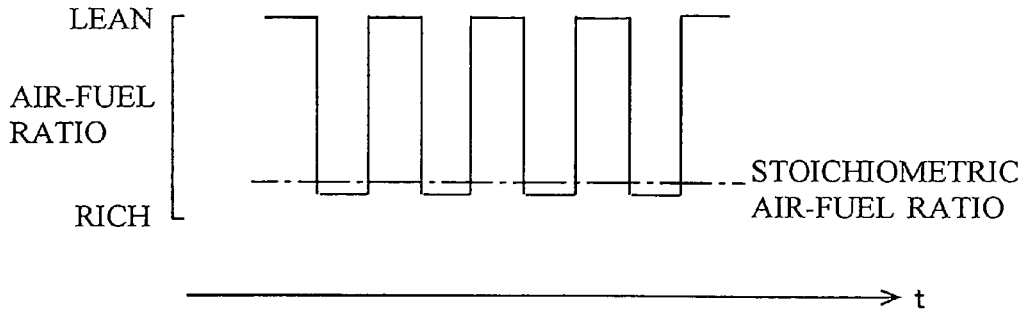
Figure 6B:
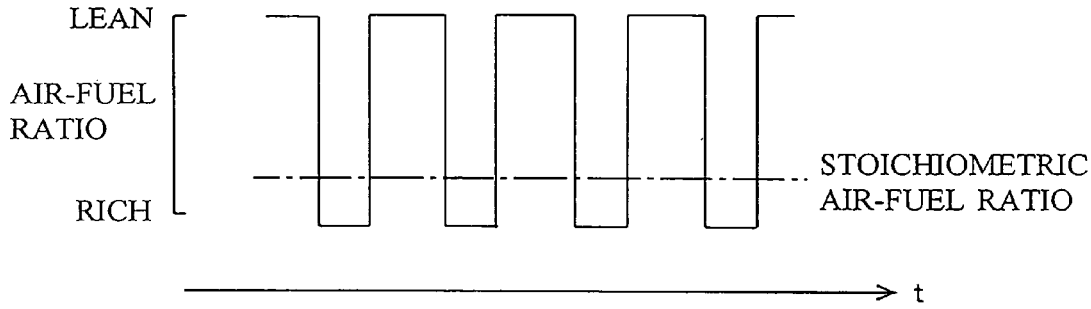
Figure 6C:
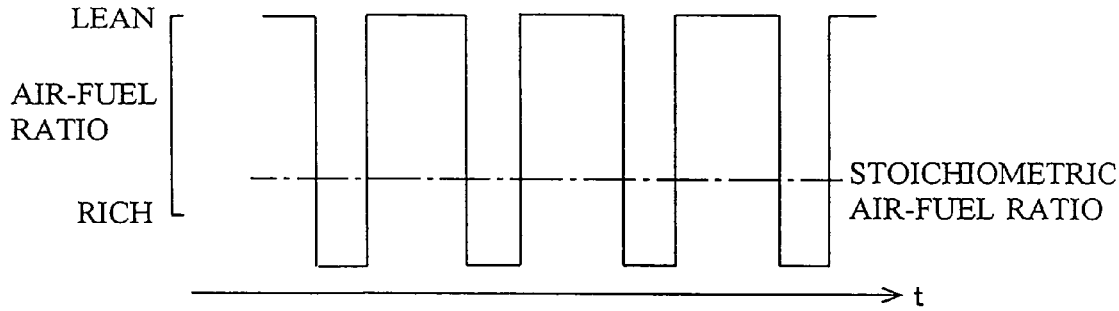

Next, reference will be made to the NOx reduction control in this embodiment based on FIGS. 6A through 6C. FIG. 6A is a timing chart that illustrates how to control the upstream side exhaust gas air-fuel ratio when the NOx occluded in the upstream NOx catalyst 3 is reduced. FIG. 6B is a timing chart that illustrates how to control the upstream side exhaust gas air-fuel ratio when the NOx occluded in the upstream and downstream NOx catalysts 3, 4 are reduced. FIG. 6C is a timing chart that illustrates how to control the upstream side exhaust gas air-fuel ratio when the NOx occluded in the downstream NOx catalyst 4 is reduced. In FIGS. 6A through 6C, the axis of abscissa represents time, and the axis of ordinate represents the upstream side exhaust gas air-fuel ratio.

In this embodiment, similar to the above-mentioned SOx reduction control, when the NOx occluded in the NOx catalysts 3, 4 are reduced, the upstream side exhaust gas air-fuel ratio is alternately changed between a rich air-fuel ratio and a lean air-fuel ratio, as shown in FIGS. 6A through 6C. At this time, when the surrounding atmospheres of both the upstream and downstream NOx catalysts 3, 4 are changed into reducing atmospheres (see FIG. 6B), the upstream side exhaust gas air-fuel ratio is made lower than when the surrounding atmosphere of the upstream NOx catalyst 3 is changed into a reducing atmosphere (see FIG. 6A). Also, at this time, when the surrounding atmospheres of both the upstream and downstream NOx catalysts 3, 4 are changed into oxidative atmospheres (see FIG. 6B), the duration for which the upstream side exhaust gas air-fuel ratio is lean is made longer than when the surrounding atmosphere of the upstream NOx catalyst 3 is changed into an oxidative atmosphere (see FIG. 6A). In other words, when the surrounding atmospheres of both the upstream and downstream NOx catalysts 3, 4 are changed into oxidative atmospheres, the duration of the oxidative atmosphere is made longer than when the surrounding atmosphere of the upstream NOx catalyst 3 is changed into an oxidative atmosphere.

Further, when the surrounding atmosphere of the downstream NOx catalyst 4 is changed into a reducing atmosphere (see FIG. 6C), the upstream side exhaust gas air-fuel ratio is made lower than when the surrounding atmospheres of both the upstream and downstream NOx catalysts 3, 4 are changed into reducing atmospheres (see FIG. 6B). Also, when the surrounding atmosphere of the downstream NOx catalyst 4 is changed into an oxidative atmosphere (see FIG. 6C), the duration for which the upstream side exhaust gas air-fuel ratio is lean is made longer than when the surrounding atmospheres of the upstream and downstream NOx catalysts 3, 4 are changed into oxidative atmospheres. In other words, when the surrounding atmosphere of the downstream NOx catalyst 4 is changed into an oxidative atmosphere, the duration of the oxidative atmosphere is made longer than when the surrounding atmospheres of both the upstream and downstream NOx catalysts 3, 4 are changed into oxidative atmospheres.

By controlling the upstream side exhaust gas air-fuel ratio in this manner, when the NOx occluded in the upstream and downstream NOx catalyst 3, 4 are reduced at the same time, or when the NOx occluded in the downstream NOx catalyst 4 is reduced, the amounts of reducing components and oxygen required in each case can be supplied to not only the upstream NOx catalyst 3 but also the downstream NOx catalyst 4. In addition, a sufficient amount of oxygen can be supplied to the downstream NOx catalyst 4 without the provision of a secondary air supply system as used conventionally. Thus, it is possible to suppress the generation of white smoke.

Here, note that at the time of NOx reduction control, the upstream side exhaust gas air-fuel ratio when the surrounding atmospheres of the respective NOx catalysts 3, 4 are changed into reducing atmospheres is not limited to a rich air-fuel ratio. That is, the upstream side exhaust gas air-fuel ratio at this time may be the stoichiometric air-fuel ratio, or any appropriate lean air-fuel ratio at which the occluded NOx can be reduced in the respective NOx catalysts 3, 4.

<Fuel Addition Control when Surrounding Atmospheres of Respective NOx Catalysts are Changed Into Reducing Atmospheres at the Time of NOx Reduction Control>

Next, reference will be made to the fuel addition control on the fuel added from the fuel addition valve 5 when the surrounding atmospheres of the respective NOx catalysts 3, 4 are changed into reducing atmospheres at the time of NOx reduction control in this embodiment. At the time of NOx reduction control, too, similar to the above-mentioned SOx reaction control, when the surrounding atmospheres of the respective NOx catalysts 3, 4 are changed into reducing atmospheres, i.e., when the upstream side exhaust gas air-fuel ratio is changed into a rich air-fuel ratio, the fuel addition valve 5 serves to add fuel to the exhaust gas by injecting the fuel a plurality of times.

Here, note that when fuel is added to the exhaust gas from the fuel addition valve 5 upon changing the surrounding atmospheres of both the upstream and downstream NOx catalysts 3, 4 into reducing atmospheres, the frequency or number of fuel injections is made smaller than, and the amount of fuel per injection is made larger than, when the surrounding atmosphere of the upstream NOx catalyst 3 is changed into a reducing atmosphere. In addition, when fuel is added to the exhaust gas from the fuel addition valve 5 upon changing the surrounding atmosphere of the downstream NOx catalyst 4 into a reducing atmosphere, the frequency or number of fuel injections is made smaller than and the amount of fuel per injection is made larger than when the surrounding atmospheres of the upstream and downstream NOx catalysts 3, 4 are changed into reducing atmospheres. In addition, the total of the amounts of fuel injected in one fuel addition when the surrounding atmospheres of both the upstream and downstream NOx catalysts 3, 4 are changed into reducing atmospheres, and the total of the amounts of fuel injected in one fuel addition when the surrounding atmosphere of the upstream NOx catalyst 3 is changed into a reducing atmosphere, and the total of the amounts of fuel injected in one fuel addition when the surrounding atmosphere of the downstream NOx catalyst 4 is changed into a reducing atmosphere may be set to the same amount.

According to the control on the fuel added from the fuel addition valve 5, when the surrounding atmospheres of both the upstream and downstream NOx catalysts 3, 4 are changed into reducing atmospheres, or when the surrounding atmosphere of the downstream NOx catalyst 4 is changed into a reducing atmosphere, the upstream side exhaust gas air-fuel ratio can be efficiently lowered with a smaller amount of fuel supply. That is, it is possible to adjust the upstream side exhaust gas air-fuel ratio suitable for the respective cases. As a result, deterioration in fuel mileage can be suppressed.

<NOx Reduction Control Routine>

Figure 7:
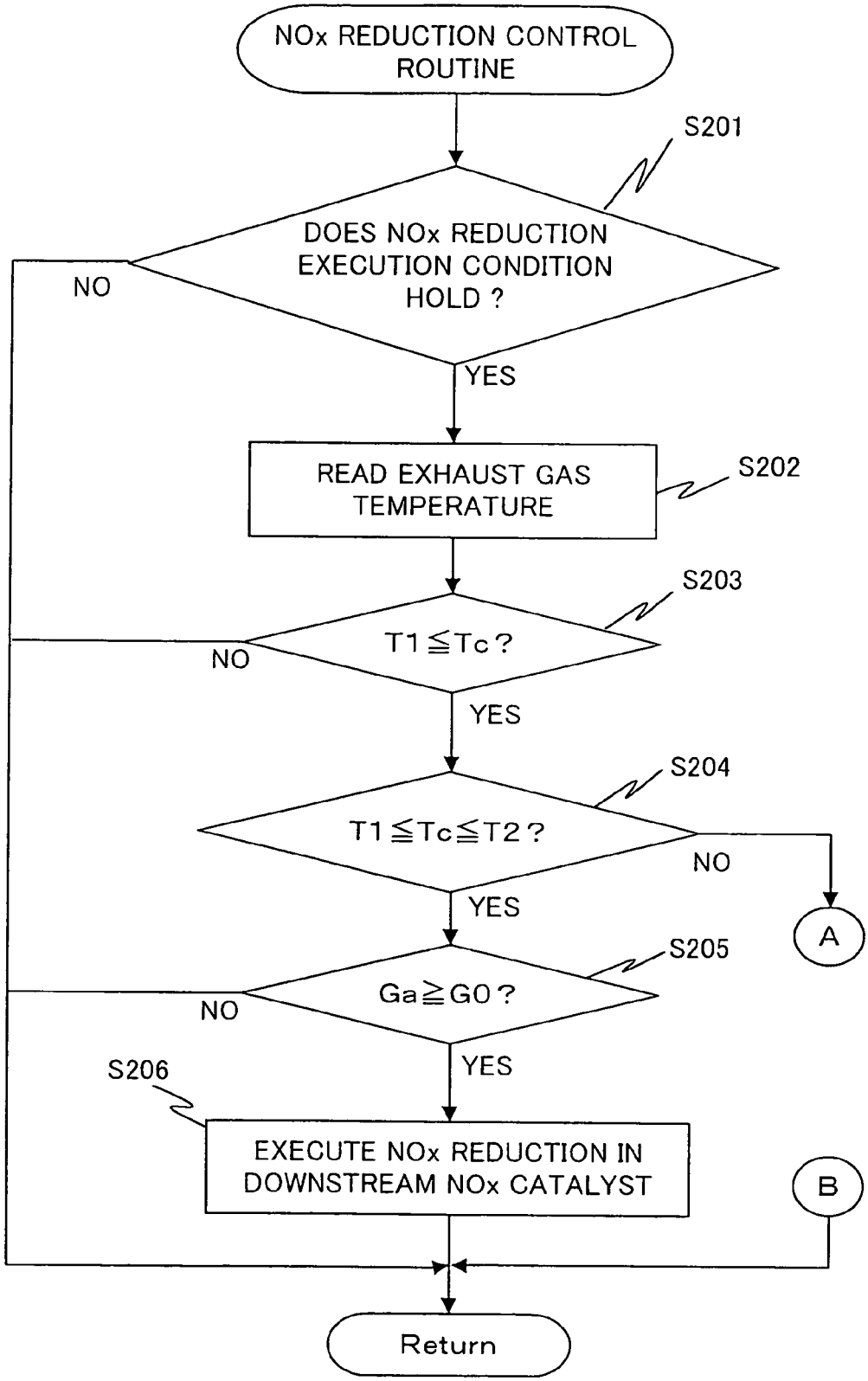
FIG. 7 is a flow chart showing a part of an NOx reduction control routine according to one embodiment of the present invention.
Figure 8:
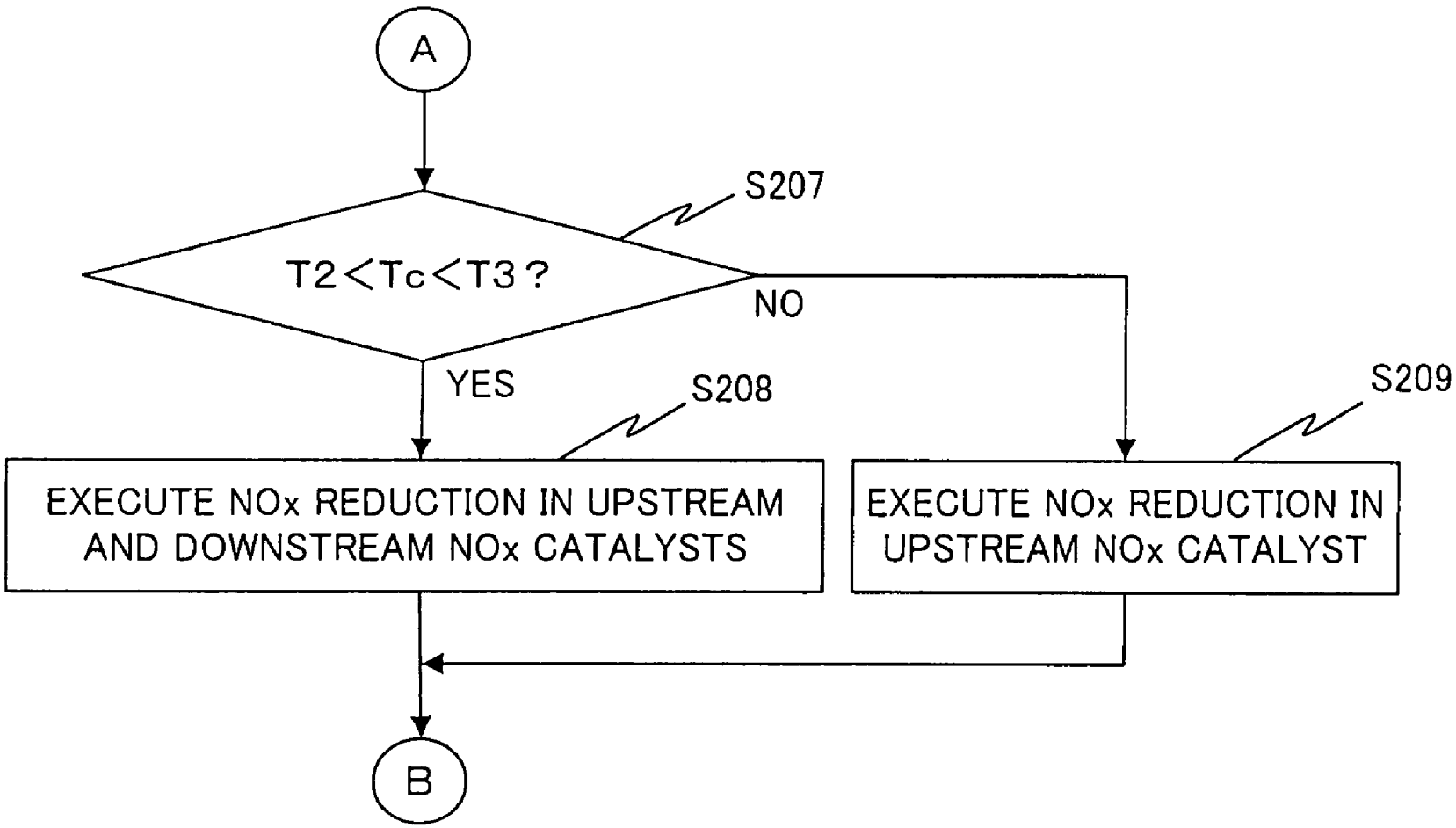
FIG. 8 is a flow chart showing another part of the NOx reduction control routine according to one embodiment of the present invention.

Next, reference will be made to a control routine for NOx reduction control in this embodiment while referring to FIGS. 7 and 8. FIGS. 7 and 8 are flow charts that illustrate the NOx reduction control routine according to this embodiment. This routine is a program beforehand stored in the ECU 10, and is executed at each specified time interval during the operation of the internal combustion engine 1.

In this routine, first in step S201, the ECU 10 determines whether an NOx reduction control execution condition holds. Here, as the NOx reduction control execution condition, there can be enumerated the elapse of a predetermined time from the end of execution of the last NOx reduction control, the attainment of a predetermined value of the integrated or accumulated amount of fuel consumed in the internal combustion engine 1 from the end of the last NOx reduction control, etc. When a positive determination is made in step S201, a control program or flow executed by the ECU 10 advances to step S202, whereas when a negative determination is made, the execution of this routine is once terminated.

In step S202, the ECU 10 reads the temperature Tc of the exhaust gas passing through the exhaust passage between the upstream NOx catalyst 3 and the downstream NOx catalyst 4 (hereinafter referred to simply as an exhaust gas temperature Tc), being detected by the exhaust gas temperature sensor 7.

Then, the control flow advances to step S203, where it is determined whether the exhaust gas temperature Tc is higher than or equal to a first specified temperature T1. Here, note that the first specified temperature T1 is a temperature value based on which a determination can be made that when the exhaust gas temperature Tc is lower than the first specified temperature T1, the temperature of the upstream NOx catalyst 3 is not within a first activation temperature range which is an activation temperature range of NOx catalyst 3 and the temperature of the downstream NOx catalyst 4 is not within a second activation temperature range which is an activation temperature range of NOx catalyst 4. This first specified temperature T1 is a value which has been determined in advance through experiments, etc. When a positive determination is made in step S203, the control flow advances to step S204, whereas when a negative determination is made, the execution of this routine is once terminated.

In step S204, it is determined whether the exhaust gas temperature Tc is higher than or equal to the first specified temperature T1 and lower than or equal to a second specified temperature T2. Here, note that the second specified temperature T2 is a temperature value based on which a determination can be made that when the exhaust gas temperature Tc is higher than or equal to the first specified temperature T1 and lower than or equal to the second specified temperature T2, the temperature of the downstream NOx catalyst 4 having a low temperature activation ability falls within the second activation temperature range but the temperature of the upstream NOx catalyst 3 does not reach the first activation temperature range. This second specified temperature T2 is a value which has been determined in advance through experiments, etc. In step S204, when a positive determination is made, the control flow advances to step S205, whereas when a negative determination is made, the control flow advances to step S207.

In step S205, it is determined whether the amount of intake air Ga sucked into the internal combustion engine 1 is greater than or equal to the specified intake air amount G0. When fuel is added from the fuel addition valve 5 to the exhaust gas so as to reduce the NOx occluded in the downstream NOx catalyst 4 on the condition that the temperature of the upstream NOx catalyst 3 is not within the first activation temperature range, the amount of the added fuel to be attached to the upstream NOx catalyst 3 might increase if the flow rate of the exhaust gas is not limited. The specified intake air amount G0 herein is an amount of intake air at which the flow rate of exhaust gas becomes greater than or equal to a specified exhaust gas flow rate when the amount of intake air Ga sucked into the internal combustion engine 1 is greater than or equal to the specified intake air amount G0. In addition, the specified exhaust gas flow rate herein is a flow rate of exhaust gas which is capable of suppressing the fuel added from the fuel addition valve 5 from being attached to the upstream NOx catalyst 3 when the flow rate of exhaust gas is greater or equal to the specified exhaust gas flow rate, even if the temperature of the upstream NOx catalyst 3 is not within the first activation temperature range. This specified intake air amount G0 is a value which has been determined in advance through experiments, etc.

When a negative determination is made in step S205, a determination is made that if fuel is added to the exhaust gas from the fuel addition valve 5, the amount of the fuel attached to the upstream NOx catalyst 3 might increase, and the execution of this routine is once terminated.

On the other hand, when a positive determination is made in step S205, the control flow advances to step S206 where the upstream side exhaust gas air-fuel ratio is controlled in the above-mentioned manner so as to reduce the NOx occluded in the downstream NOx catalyst 4, and then the execution of this routine is once terminated.

In step S207, it is determined whether the exhaust gas temperature Tc is higher than the second specified temperature T2, and lower than a third specified temperature T3. Here, note that the third specified temperature T3 is a value based on which a determination is made that when the exhaust gas temperature Tc is higher than the second specified temperature T2 and lower than the third specified temperature T3, both the temperature of the upstream NOx catalyst 3 and the temperature of the downstream NOx catalyst 4 are within the first and second activation temperature ranges of the respective NOx catalysts 3, 4, respectively. In addition to this, the third specified temperature T3 is also a temperature value based on which a determination can be made that when the exhaust gas temperature Tc is higher than or equal to the third specified temperature T3, the temperature of the upstream NOx catalyst 3 is within the first activation temperature range but the temperature of the downstream NOx catalyst 4 exceeds the second activation temperature range. This third specified temperature T3 is a value which has been determined in advance through experiments, etc. In step S207, when a positive determination is made, the control flow advances to step S208, whereas when a negative determination is made, the control flow advances to step S209.

In step S208, the upstream side exhaust gas air-fuel ratio is controlled in the above-mentioned manner so as to reduce the NOx occluded in the upstream and downstream NOx catalysts 3, 4 at the same time, and then the execution of this routine is once terminated. On the other hand, in step S209, the upstream side exhaust gas air-fuel ratio is controlled in the above-mentioned manner so as to reduce the NOx occluded in the upstream NOx catalyst 3, and then the execution of this routine is once terminated.

According to the NOx reduction control routine as stated above, the NOx occluded in the respective NOx catalysts 3, 4 can be reduced at appropriate times, respectively, so the NOx can be reduced earlier with a smaller amount of reducing agent. Thus, it is possible to suppress the generation of white smoke as well as deterioration in fuel mileage. In addition, it is also possible to suppress the fuel to be added as a reducing agent from being attached to the upstream NOx catalyst 3 when the NOx occluded in the downstream NOx catalyst 4 is reduced.

According to this embodiment, the SOx occluded in the NOx catalysts can be reduced in a more appropriate manner by performing the SOx reduction control as stated above, and the NOx occluded in the NOx catalysts can also be reduced in a more appropriate manner by performing the NOx reduction control as mentioned above. As a result, the exhaust gas cleaning or purification abilities of the NOx catalysts can be recovered more suitably, and hence the cleaning or purification of the exhaust gas can be performed more effectively.

While the invention has been described in terms of a preferred embodiment, those skilled in the art will recognize that the invention can be practiced with modifications within the spirit and scope of the appended claims.

What is claimed is:

1. An exhaust gas purifying system for an internal combustion engine, comprising:

a first NOx storage reduction catalyst disposed on an exhaust passage;

a second NOx storage reduction catalyst disposed on said exhaust passage at a location downstream of said first NOx storage reduction catalyst; and a controller that controls an air-fuel ratio changing device to control the air-fuel ratio of exhaust gas in such a manner that:

when oxides occluded in said first NOx storage reduction catalyst or said second NOx storage reduction catalyst are reduced, the surrounding atmosphere of that one of said first and second NOx storage reduction catalysts, in which the oxides are reduced, is changed between an oxidative atmosphere and a reducing atmosphere by intermittently supplying a reducing agent to an exhaust gas at a location upstream of said first NOx storage reduction catalyst thereby to change the air-fuel ratio of the exhaust gas at an upstream side of said first NOx storage reduction catalyst;

when the surrounding atmosphere of said second NOx storage reduction catalyst is changed into a reducing atmosphere, the air-fuel ratio of the exhaust gas at an upstream side of said first NOx storage reduction catalyst is made lower than when the surrounding atmosphere of said first NOx storage reduction catalyst is changed into a reducing atmosphere; and when the surrounding atmosphere of said second NOx storage reduction catalyst is changed into an oxidative atmosphere, the duration of the oxidative atmosphere is made longer than when the surrounding atmosphere of said first NOx storage reduction catalyst is changed into an oxidative atmosphere.

2. The exhaust gas purifying system for an internal combustion engine as set forth in claim 1, wherein said reducing agent is fuel; and said controller controls the air-fuel ratio changing device to control the air-fuel ratio of the exhaust gas in such a manner that:

when fuel is supplied to the exhaust gas at a location upstream of said first NOx storage reduction catalyst, the fuel is injected a plurality of times; and when the surrounding atmosphere of said second NOx storage reduction catalyst is changed into a reducing atmosphere, the air-fuel ratio of the exhaust gas at an upstream side of said first NOx storage reduction catalyst is further lowered by supplying the same amount of fuel to the exhaust gas at a location upstream of said first NOx storage reduction catalyst at a decreased frequency of injections with an increased amount of fuel per injection, in comparison with the time when the surrounding atmosphere of said first NOx storage reduction catalyst is changed into a reducing atmosphere.

3. The exhaust gas purifying system for an internal combustion engine as set forth in claim 1, wherein said second NOx storage reduction catalyst has a characteristic of being activated at a temperature lower than that at which said first NOx storage reduction catalyst is activated.

4. An exhaust gas purifying system for an internal combustion engine, comprising:

a first NOx storage reduction catalyst disposed on an exhaust passage;

a second NOx storage reduction catalyst disposed on said exhaust passage at a location downstream of said first NOx storage reduction catalyst and having an activation temperature different from that of said first NOx storage reduction catalyst; and an air-fuel ratio changing device that serves to control the air-fuel ratio of exhaust gas in such a manner that:

when the NOx occluded in said first NOx storage reduction catalyst or said second NOx storage reduction catalyst are/is reduced, the surrounding atmosphere of that one of said first and second NOx storage reduction catalysts, in which the NOx is reduced, is changed between an oxidative atmosphere and a reducing atmosphere by intermittently supplying a reducing agent to the exhaust gas at a location upstream of said first NOx storage reduction catalyst thereby to change the air-fuel ratio of the exhaust gas at an upstream side of said first NOx storage reduction catalyst;

when the NOx occluded in said first NOx storage reduction catalyst or said second NOx storage reduction catalyst are/is reduced, the NOx occluded in said first NOx storage reduction catalyst is reduced, or the NOx occluded in said second NOx storage reduction catalyst is reduced, or the NOx occluded in said first and second NOx storage reduction catalysts are reduced in accordance with the temperatures of said first NOx storage reduction catalyst and said second NOx storage reduction catalyst;

when the surrounding atmospheres of said first and second NOx storage reduction catalysts are changed into reducing atmospheres, the air-fuel ratio of exhaust gas at an upstream side of said first NOx storage reduction catalyst is made lower than when the surrounding atmosphere of said first NOx storage reduction catalyst is changed into a reducing atmosphere;

when the surrounding atmospheres of said first and second NOx storage reduction catalysts are changed into oxidative atmospheres, the duration of the oxidative atmosphere is made longer than when the surrounding atmosphere of said first NOx storage reduction catalyst is changed into an oxidative atmosphere;

when the surrounding atmosphere of said second NOx storage reduction catalyst is changed into a reducing atmosphere, the air-fuel ratio of exhaust gas at an upstream side of said first NOx storage reduction catalyst is made lower than when the surrounding atmospheres of said first and second NOx storage reduction catalysts are changed into reducing atmospheres; and when the surrounding atmosphere of said second NOx storage reduction catalyst is changed into an oxidative atmosphere, the duration of the oxidative atmosphere is made longer than when the surrounding atmospheres of said first and second NOx storage reduction catalysts are changed into oxidative atmospheres.

5. The exhaust gas purifying system for an internal combustion engine as set forth in claim 4, wherein said reducing agent is fuel; and said air-fuel ratio changing device serves to control the air-fuel ratio of the exhaust gas in such a manner that:

when fuel is supplied to the exhaust gas at a location upstream of said first NOx storage reduction catalyst, the fuel is injected a plurality of times;

when the surrounding atmospheres of said first and second NOx storage reduction catalysts are changed into reducing atmospheres, the air-fuel ratio of the exhaust gas at an upstream side of said first NOx storage reduction catalyst is further lowered by supplying the same amount of fuel to the exhaust gas at a location upstream of said first NOx storage reduction catalyst at a decreased frequency of injections with an increased amount of fuel per injection, in comparison with the time when the surrounding atmosphere of said first NOx storage reduction catalyst is changed into a reducing atmosphere; and when the surrounding atmosphere of said second NOx storage reduction catalyst is changed into a reducing atmosphere, the air-fuel ratio of the exhaust gas at an upstream side of said first NOx storage reduction catalyst is further lowered by supplying the same amount of fuel to the exhaust gas at a location upstream of said first NOx storage reduction catalyst at a decreased frequency of injections with an increased amount of fuel per injection, in comparison with the time when the surrounding atmospheres of said first and second NOx storage reduction catalysts are changed into reducing atmospheres.

6. The exhaust gas purifying system for an internal combustion engine as set forth in claim 4, wherein said air-fuel ratio changing device serves to control the air-fuel ratio of the exhaust gas in such a manner that:

when the temperature of only said first NOx storage reduction catalyst is within a first activation temperature range, the NOx occluded in said first NOx storage reduction catalyst is reduced;

when the temperature of only said second NOx storage reduction catalyst is within a second activation temperature range, the NOx occluded in said second NOx storage reduction catalyst is reduced; and when the temperatures of both said first and second NOx storage reduction catalysts are within said first and second activation temperature ranges, respectively, the NOx occluded in said first and second NOx storage reduction catalysts are reduced.

7. The exhaust gas purifying system for an internal combustion engine as set forth in claim 2, wherein said second NOx storage reduction catalyst has a characteristic of being activated at a temperature lower than that at which said first NOx storage reduction catalyst is activated.

8. The exhaust gas purifying system for an internal combustion engine as set forth in claim 5, wherein said air-fuel ratio changing device serves to control the air-fuel ratio of the exhaust gas in such a manner that:

when the temperature of only said first NOx storage reduction catalyst is within a first activation temperature range, the NOx occluded in said first NOx storage reduction catalyst is reduced;

when the temperature of only said second NOx storage reduction catalyst is within a second activation temperature range, the NOx occluded in said second NOx storage reduction catalyst is reduced; and when the temperatures of both said first and second NOx storage reduction catalysts are within said first and second activation temperature ranges, respectively, the NOx occluded in said first and second NOx storage reduction catalysts are reduced.

* * * * *